US007498990B2

(12) United States Patent
Park et al.

(10) Patent No.: US 7,498,990 B2
(45) Date of Patent: Mar. 3, 2009

(54) INTERNAL ANTENNA HAVING PERPENDICULAR ARRANGEMENT

(75) Inventors: Il Hwan Park, Kyungki-do (KR); Chul Ho Kim, Kyungki-do (KR); Jong Lae Kim, Daejeon (KR); Hyun Hak Kim, Kyungki-do (KR)

(73) Assignee: Samsung Electro-Mechanics Co., Ltd., Suwon, Kyungki-Do (KR)

( * ) Notice: Subject to any disclaimer, the term of this patent is extended or adjusted under 35 U.S.C. 154(b) by 4 days.

(21) Appl. No.: 11/457,393

(22) Filed: Jul. 13, 2006

(65) Prior Publication Data

US 2007/0013589 A1 Jan. 18, 2007

(30) Foreign Application Priority Data

Jul. 15, 2005 (KR) ..... 10-2005-0064291

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS
See application file for complete search history.

(56) References Cited

U.S. PATENT DOCUMENTS 6,456,242 B1 * 9/2002 Crawford ..... 343/700 MS
7,164,387 B2 * 1/2007 Sievenpiper ..... 343/702
7,170,453 B2 * 1/2007 Noguchi et al. ..... 343/702
2005/0093752 A1 * 5/2005 Cheng et al. ..... 343/702

FOREIGN PATENT DOCUMENTS

| | | | |
|---|---|---|---|
| JP | 2000-183634 A | | 6/2000 |
| KR | 1020040004218 | | 1/2004 |
| KR | 2004-93407 A | | 11/2004 |
| KR | 1020050040302 A | | 5/2005 |
| WO | WO2004/102737 | * | 11/2004 |

OTHER PUBLICATIONS

Korean Intellectual Property Office, Office Action mailed, Oct. 23, 2006.

* cited by examiner

*Primary Examiner*—Hoang V Nguyen
*Assistant Examiner*—Robert Karacsony
(74) *Attorney, Agent, or Firm*—Lowe Hauptman Ham & Berner

(57) ABSTRACT

In an internal antenna, a first antenna part is disposed on a side of a mobile telecommunication terminal body having at least first and second peripheral surfaces and sides. The first antenna part processes a signal of a first band. Also, a second antenna part is disposed on one of the peripheral surfaces of the mobile telecommunication body. The second antenna part processes a signal of a second band.

5 Claims, 9 Drawing Sheets

(a)

(b)

(a)

(b)

(c)

(a)

(b)

INTERNAL ANTENNA HAVING PERPENDICULAR ARRANGEMENT

CLAIM OF PRIORITY

This application claims the benefit of Korean Patent Application No. 2005-64291 filed on Jul. 15, 2005 in the Korean Intellectual Property Office, the disclosure of which is incorporated herein by reference.

BACKGROUND OF THE INVENTION

1. Field of the Invention

The present invention relates to an antenna installed in a mobile telecommunication terminal, and more particularly to a built-in antenna capable of processing wide-band or multi-band signals while occupying a minimum space in the mobile telecommunication terminal.

2. Description of the Related Art

Recently, a rising demand for wireless devices installed inside mobile telecommunication terminals has led to diversity in frequency bands used in an antenna of such a terminal. Specifically, frequency bands currently used in the mobile telecommunication terminals include 800 MHz to 2 GHz (for mobile phones), 2.4 GHz to 5 GHz (for wireless LAN), 113.56 MHz (for contactless RFID), 2.4 GHz (for Bluetooth), 1.575 GHz (for GPS), 76 to 90 MHz (for FM radio), 470 to 770 MHz (for TV broadcasting) and other bands for ultra wideband (UWB), Zigbee, Digital Multimedia Broadcasting (DMB) and the like. The DMB band is classified into 2630 to 2655 MHz for satellite DMB and 180 to 210 MHz for terrestrial DMB.

Meanwhile, the mobile telecommunication terminals have been faced with demands for smaller size, lighter weight and various service functions as well. To meet such demands, the mobile telecommunication terminals tend to employ an antenna and other components which are more compact-sized and multi-functional. Furthermore, increasingly the mobile telecommunication terminals are internally equipped with the antenna. Therefore, to be installed inside the terminals, the antenna needs to occupy a very small space, while performing with satisfactory capabilities.

FIG. 1 is a configuration view illustrating a conventional built-in Planar Inverted F Antenna (PIFA) 10.

The PIFA 10 is an antenna designed for installation in a mobile telecommunication terminal. As shown in FIG. 1, the PIFA 10 generally includes a planar radiating part 11, a shorting pin 12 connected to the radiating part 11, a coaxial line 13, and a ground plate 14. The radiating part 11 is fed with current via the coaxial line 13 and short-circuited to the ground pate 14 by the shorting pin 12 to achieve an impedance match. The PIFA 10 needs to be designed by considering the length L of the radiating part 11 and height H of the antenna in accordance with the width Wp of the shorting pin 12 and width W of the radiating part 11.

The PIFA 10 is characterized by directivity. That is, when current induced to the radiating part 11 generates beams, a beam flux directed toward a ground surface is re-induced to attenuate another beam flux directed toward the human body, thereby improving SAR characteristics and enhancing intensity of the beam flux induced to the radiating part 11. The PIFA operates as a rectangular micro-strip antenna, in which the length of a rectangular panel-shaped radiator is substantially halved, thereby realizing a low profile structure. Moreover, the PIFA is installed inside the terminal as a built-in antenna so that the terminal can be designed with an aesthetic appearance and significantly withstand external impact. The PIFA 10 has been upgraded considerably in line with a multi-functional trend.

FIG. 2 is a configuration view illustrating a conventional ceramic chip antenna 20.

Referring to FIG. 2, inside the conventional ceramic chip antenna 20, conductors 22 and 23 for radiating are formed via a lamination process. In FIG. 2, the conductors 22 and 23 are formed in a spiral coil shape, which, however, can be modified variously. The conductors 22 and 23 are comprised of a parallel strip line 22 printed in parallel with an undersurface 21 of the conductors 22 and 23, and a perpendicular strip line 23 formed by filling a via hole disposed perpendicular to the undersurface 21 with a conductive paste. Also, the conductors 22 and 23 have an end 24 powered and the other end 25 grounded.

Further, conventionally, in built-in antennas 10 and 20 as shown in FIG. 1 or 2, a radiating part 2 of the PIFA 10 is modified in its form and a plurality of conductors 22 and 23 are disposed inside the chip antenna to achieve multi-band or wide-band performance. But the conventional built-in antenna is installed in a small size inside a mobile telecommunication terminal such as a mobile phone so that the radiating part 2 of the PIFA 10 is necessarily altered in its form or the conductors 22 and 23 disposed inside the chip antenna 20 is limited in their length. Therefore, disadvantageously, the conventional built-in antennas 10 and 20 hardly process signals of various bandwidths in the mobile telecommunication terminal.

SUMMARY OF THE INVENTION

The present invention has been made to solve the foregoing problems of the prior art and therefore an object according to certain embodiments of the present invention is to provide a frequency-tunable antenna capable of processing a multi-band or a wide-band while occupying a minimum space in a mobile telecommunication terminal.

According to an aspect of the invention for realizing the object, there is provided an internal antenna having a perpendicular arrangement, comprising: a first antenna part for processing a signal of a first band, the first antenna part disposed on a side of a mobile telecommunication terminal body having at least first and second peripheral surfaces and sides; and a second antenna part for processing a signal of a second band higher than the first band, the second antenna part disposed on one of the peripheral surfaces of the mobile telecommunication terminal body.

Preferably, the first and second antenna parts are connected to a first feeding part for feeding current through an equal feeding line. The first antenna part is connected to a ground part for grounding.

Also, preferably, the first antenna part and at least some portions of the ground part and the first feeding part are formed on a flexible substrate.

Preferably, the second antenna part is an adjustable antenna capable of adjusting a processing bandwidth thereof. At this time, preferably, the internal antenna further comprises a control part for providing a control signal to control the processing bandwidth of the second antenna part.

The control part comprises a switching circuit connecting a pin diode or a varactor to a predetermined point of a radiator installed inside the second antenna part.

Preferably, a gap between the first and second antenna parts ranges from $\lambda/4$ to $\lambda/2$, where $\lambda$ is a free space wavelength.

In addition, according to a certain embodiment of the invention, the internal antenna further comprises: a third antenna part for processing a signal of a third band, the third antenna disposed on the side of the mobile telecommunication terminal body; a fourth antenna part for processing a signal of a fourth band higher than the third band, the fourth antenna part disposed on the one of the peripheral surfaces of the mobile telecommunication terminal body; and a second feeding part for feeding current to the third and fourth antennas through an equal feeding line, wherein the second feeding part is electrically connected to the first feeding part.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Figure 1:
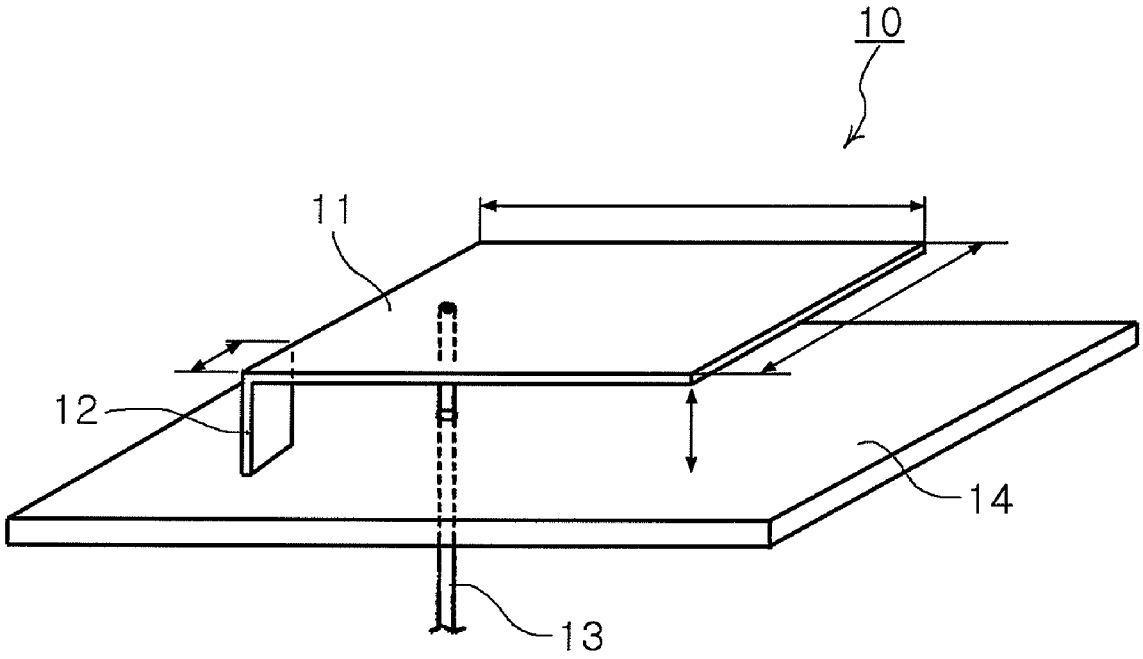
PRIOR ART FIG. 1
FIG. 1 is a configuration view illustrating a conventional Planar Inverted F Antenna (PIFA).
Figure 2:
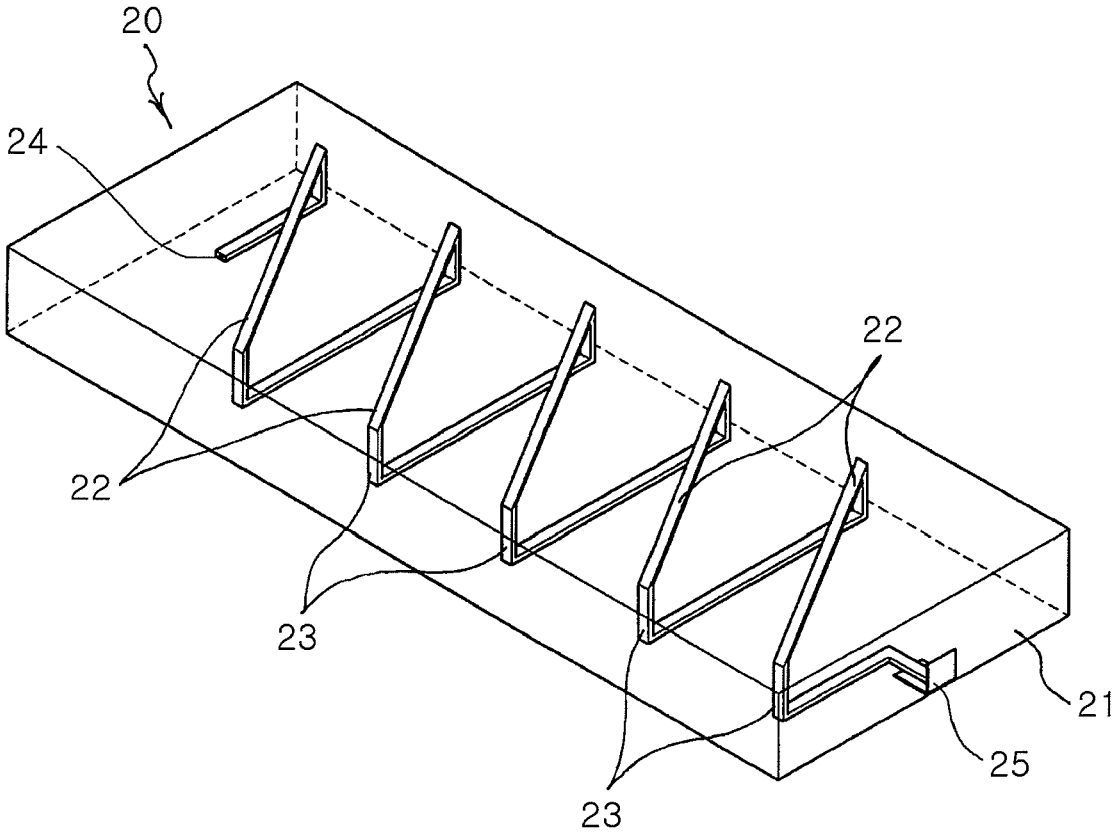
PRIOR ART FIG. 2
FIG. 2 is a configuration view illustrating a conventional ceramic chip antenna.

Preferred embodiments of the present invention will now be described in detail with reference to the accompanying drawings, in which the same reference numerals are used throughout the different drawings to designate the same or similar components. In the following description, well-known functions and constructions will not be described in detail since they would obscure the intention in unnecessary detail.

Figure 3:
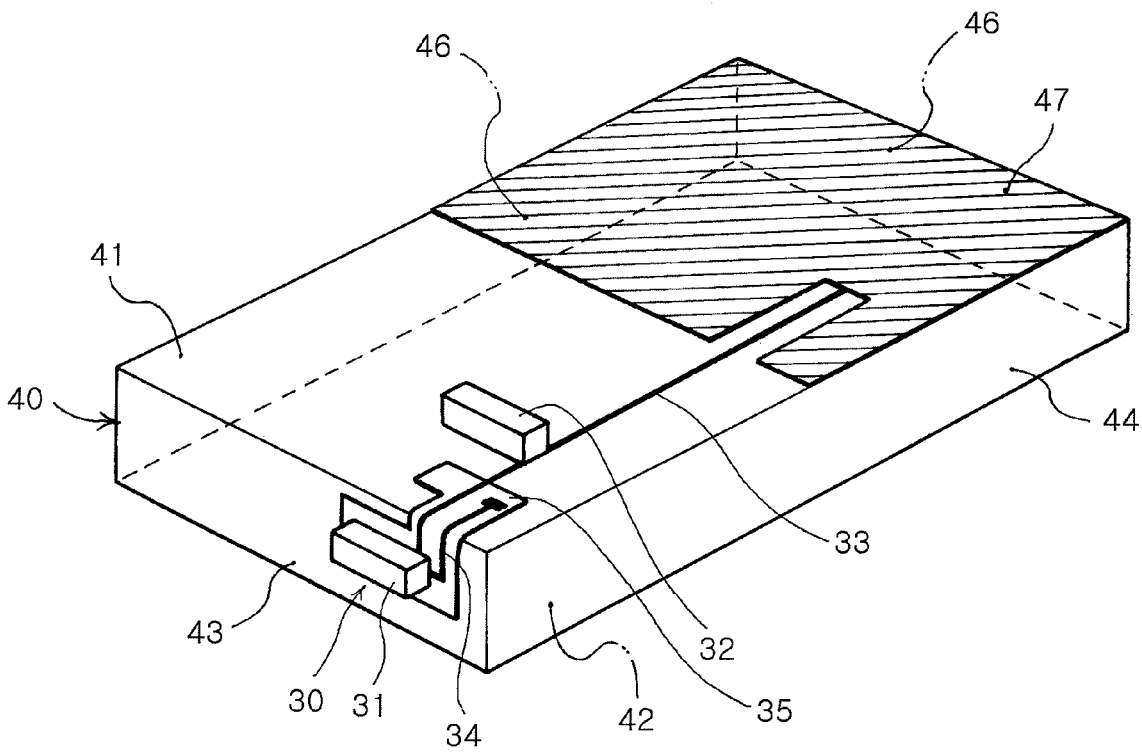
FIG. 3 is a configuration view illustrating an internal antenna having a perpendicular arrangement according to an embodiment of the invention.

FIG. 3 is a configuration view illustrating an antenna 30 having a perpendicular arrangement according to an embodiment of the invention.

Referring to FIG. 3, the internal antenna 30 having the perpendicular arrangement according to the embodiment of the invention includes a first antenna part 31 disposed on a side 43 of a mobile telecommunication terminal body 40 and a second antenna part 32 disposed on a peripheral surface 41 of the terminal body 40.

The mobile telecommunication terminal mounted with the internal antenna 30 having the perpendicular arrangement of the invention is a portably compact telecommunication device such as a mobile phone, a personal digital assistant (PDA) or a portal computer. The mobile telecommunication terminal includes a body 40 with a circuit for communication and an element, which is mounted inside an exterior housing (not illustrated). The mobile telecommunication terminal body 40 is downsized in line with a miniaturization trend of terminals and includes at least first and second peripheral surfaces 41 and 42 and sides 43 to 46. The first and second peripheral surfaces 41 and 42 are sized larger than the sides 43 to 46 such that communication circuits are formed thereon. The terminal body 40 is structured in a substantially rectangular parallelpiped shape, but may have various configurations such as a curved surface according to various designs of the mobile telecommunication terminal.

The first antenna part 31 is disposed on one side 43 of the mobile telecommunication terminal body 40. The first antenna part 31 is configured into a chip antenna but may be formed in various structures such as a linear, planar or three-dimensional structure. The first antenna part 31 functions to radiate or receive a signal of a first band.

The second antenna part 32 is disposed on one peripheral surface 41 of the mobile telecommunication terminal body 40. The second antenna part 32 is also configured into a chip antenna and may be formed in various structures such as a linear, planar or three dimensional structure. The second antenna part 32 functions to radiate or receive a signal of a second band higher than the first band.

The first and second antenna parts 31 and 32 are connected to a feeding part 33 made of an equal conductive line. The feeding part 33 is connected to a circuit 47 installed on the peripheral surface 41 of the mobile telecommunication body 40 and feeds current to the first and second antenna parts 31 and 32. The first antenna part 31 radiates the signal of the first band and the second antenna part 32 radiates the signal of the second band through current fed from the feeding part 33. Preferably, the feeding part 33 is extended linearly from the circuit 47 for supplying current, and bent on a boundary between the peripheral surface 41 and side 43. Each end of the first and second antenna parts 31 and 32 is connected to the feeding part 33 so that the first and second antenna parts 31 and 32 are arranged perpendicular to each other.

The first antenna part 31 is connected to the ground part 34. The ground part 34 is connected to a ground surface (not illustrated) formed in the mobile telecommunication terminal, thereby grounding the internal antenna 30 having the perpendicular arrangement.

The first antenna part 31 and at least some portions of the ground part 34 and the feeding part 33 are formed on a flexible substrate 35 made of a non-conductive material. The substrate 35 is foldably or bendably flexible. Accordingly, the substrate 35 can be bent to be located on the peripheral surface 41 or side 43 of the mobile telecommunication terminal. To be flexible, the substrate 35 is made of a reversible material such as polymer or a flexible metal, or a non-reversible material such as polymide, polyester and glass epoxy. The substrate 35 may be structured into a single-layer substrate made of one selected from the aforesaid group or a composite multi-layer substrate in which sheets made of at least one selected from the group are adhered via an organic adherent.

In such an internal antenna 30 having the perpendicular arrangement according to the invention, the first antenna part 31 and the second antenna part 32 are arranged in a 1×2 perpendicular arrangement, thereby compensating for co-polarization and cross-polarization properties for each other. This is due to the antenna characteristics that only one of a horizontally polarized wave and a vertically polarized wave has excellent linear polarization. Thus, based on examination of properties of the respective antennas, a horizontally (or vertically) polarized wave radiated from the first antenna part 31 radiates smoothly, while a vertically (or horizontally) polarized wave from the first antenna part 31 radiates poorly. Also, a horizontally (or vertically) polarized wave radiated from the second antenna part 32 radiates smoothly, while a vertically (or horizontally) polarized wave from the second antenna part 32 radiates poorly. But according to this disclosure of the invention, the first antenna part 31 and the second antenna part 32 are arranged perpendicular to each other. Therefore, the horizontally polarized wave of the first antenna part 31 compensates for a vertically polarized wave of the second antenna part 32. Likewise, the horizontally polarized wave of the second antenna part 32 compensates for the vertically polarization wave of the first antenna part 31. In this fashion, the first and second antenna parts 31 and 32 compensate for directions of a null point that arise therefrom each other. Consequently, the internal antenna 30 having the perpendicular arrangement can radiate with an overall uniform pattern having non-directivity.

Figure 4:
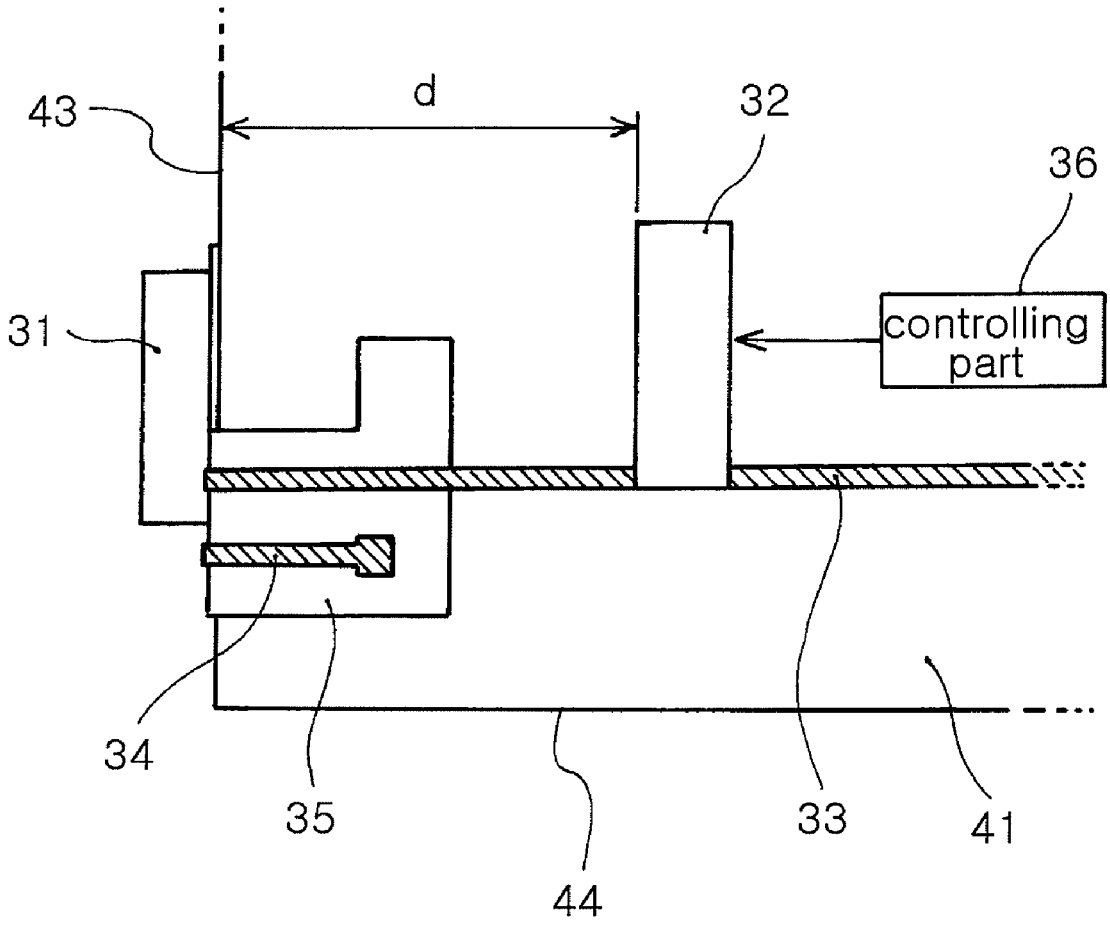
FIG. 4 is a side sectional view illustrating an internal antenna having a perpendicular arrangement according to an embodiment of the invention.

FIG. 4 is a side sectional view illustrating the internal antenna 30 having a perpendicular arrangement according to an embodiment of the invention.

Referring to FIG. 4, the internal antenna 30 having the perpendicular arrangement of the invention adjusts a distance d between the first and second antenna parts 31 and 32, thereby controlling a processing bandwidth of the internal antenna 30 having the perpendicular arrangement. In general, for an antenna arranged to have directivity, in case where a distance between radiation elements is smaller than $\lambda/4$, wherein $\lambda$ is a free space wavelength, radiation beams are synthesized less, leading to a small increase in gain. Meanwhile, in case where a distance between the radiation elements is greater than $\lambda/2$, gain is increased but sidelobe is also relatively raised, resulting in inadequate synthesis of beams. Therefore, according to this embodiment of the invention, preferably, a distance d between the first antenna part 31 and the second antenna part 32 ranges from $\lambda/4$ to $\lambda/2$, wherein $\lambda$ is a free space wavelength. As a result, this minimizes cross-coupling and interference between the first antenna part 31 and second antenna part 32.

In addition, according to the invention, the first and second antenna parts 31 and 32 each have a phase thereof determined by a length of the feeding part 33, and electro-magnetic coupling between the first and second antenna parts 31 and 32. Furthermore, according to the invention, the first and second antenna parts 31 and 32 are configured into the same type of antenna, but may feature different frequencies for processing and electrical properties. For example, as shown in FIG. 4, the second antenna part 32 is an adjustable antenna capable of controlling a processing bandwidth by adjusting a length of the radiator (not illustrated) installed inside the second antenna part 32. The second antenna part 32 controls the processing bandwidth in response to a control signal supplied by the controller 36. The controller 36 is configured into a switching circuit that connects a pin diode or a varactor to a predetermined point of the radiator installed in the second antenna part 32, thereby controlling a tuning point of the second antenna part 32. Consequently, the internal antenna 30 having the perpendicular arrangement according to the invention freely adjusts a frequency used into a single band or a dual band.

Figure 5:
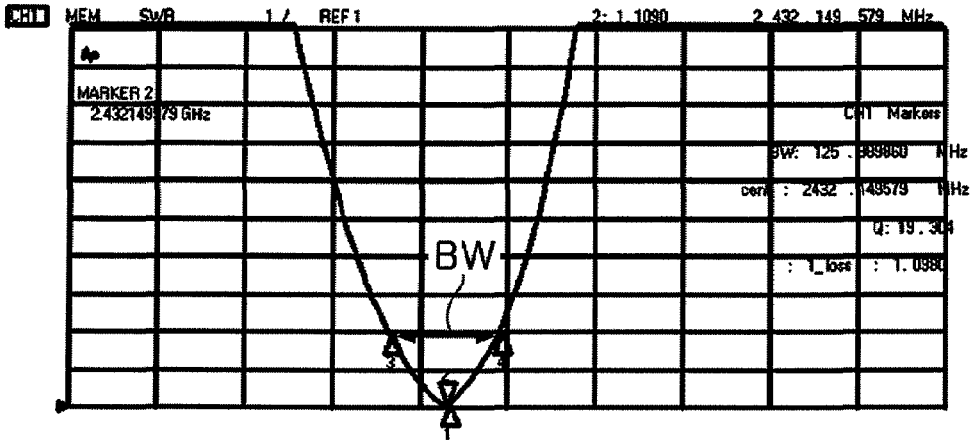
FIG. 5 is a graph illustrating a Voltage Standing Wave Ratio (VSWR) of an internal antenna having a perpendicular arrangement according to an embodiment of the invention.
Figure 5:
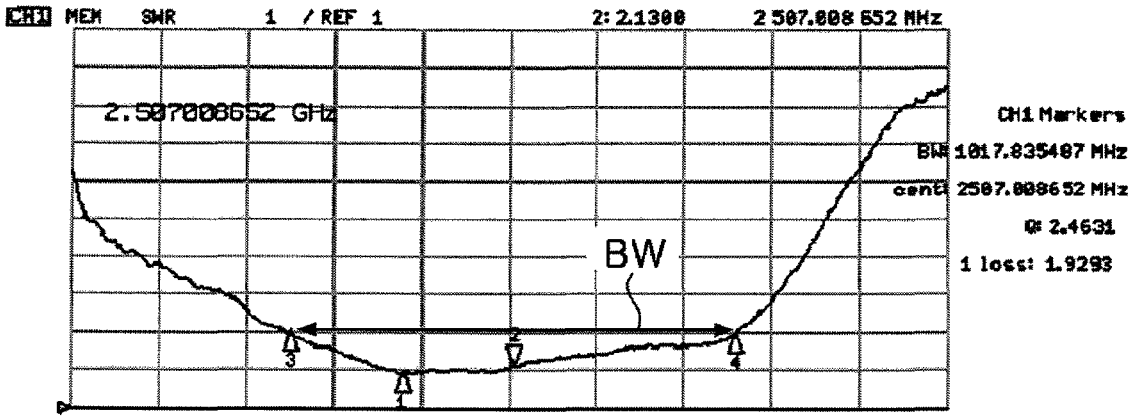

FIG. 5 is a graph illustrating VSWR properties of an internal antenna having a perpendicular arrangement according to a certain embodiment of the invention.

In the graph of FIGS. 5(*a*) and 5(*b*), a longitudinal axis indicates a Voltage Standing Wave Ratio (VSWR) which is 1 at the lowest point and increased by 1 per scale in an upward direction. A lateral axis indicates a frequency. Frequencies and VSWR measured at a point marked with "Δ" are exhibited on the right side and upper part.

FIG. 5(*a*) illustrates VSWR properties of a chip antenna having a bandwidth BW of 125 MHz (4%) at a center frequency of 2.5 GHz. FIG. 5(*b*) illustrates VSWR properties in case where a chip antenna of a high frequency band having properties of FIG. 5(*a*) is employed as the first and second antenna parts 31 and 32 of the internal antenna 30 having the perpendicular arrangement according to the invention.

As shown in FIG. 5(*b*), the internal antenna having the perpendicular arrangement of the invention has a bandwidth BW of 1017 MHz (41%) at a center frequency of 2.5 GHz, thus characterized as a wide band. Alternatively, the internal antenna 30 having the perpendicular arrangement, which adopts a low frequency band as the first and second antenna parts 31 and 32, achieves wide-band or multi-band characteristics at a low band of e.g., UHF.

Figure 6:
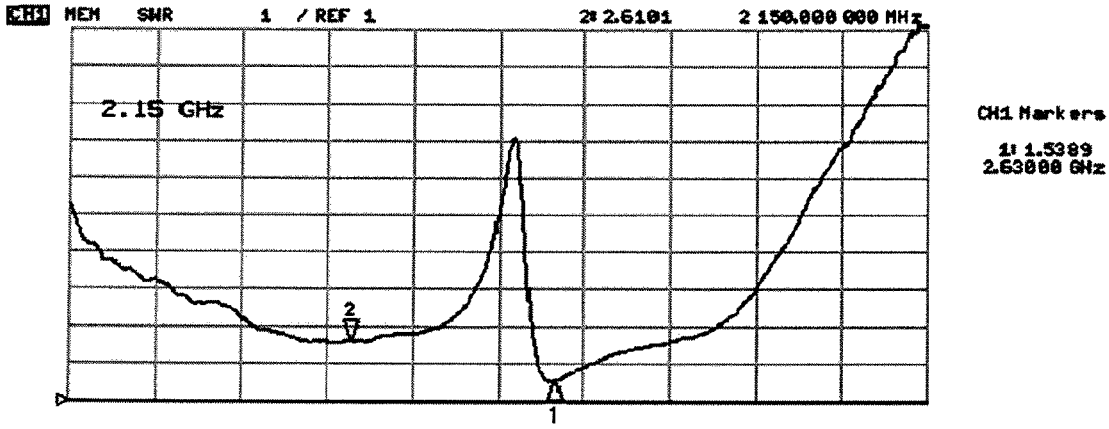
FIG. 6 is a graph illustrating results of frequency tuning via an antenna having a perpendicular arrangement according to an embodiment of the invention.
Figure 6:
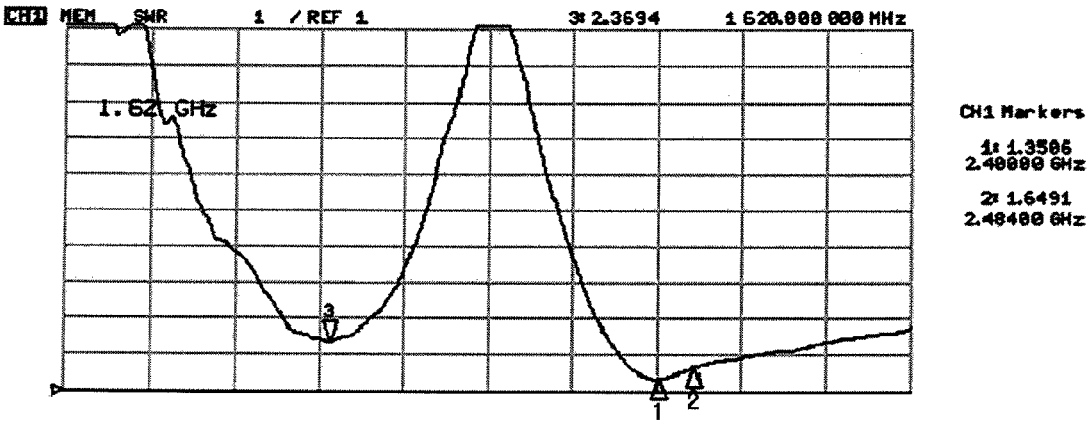
Figure 6:
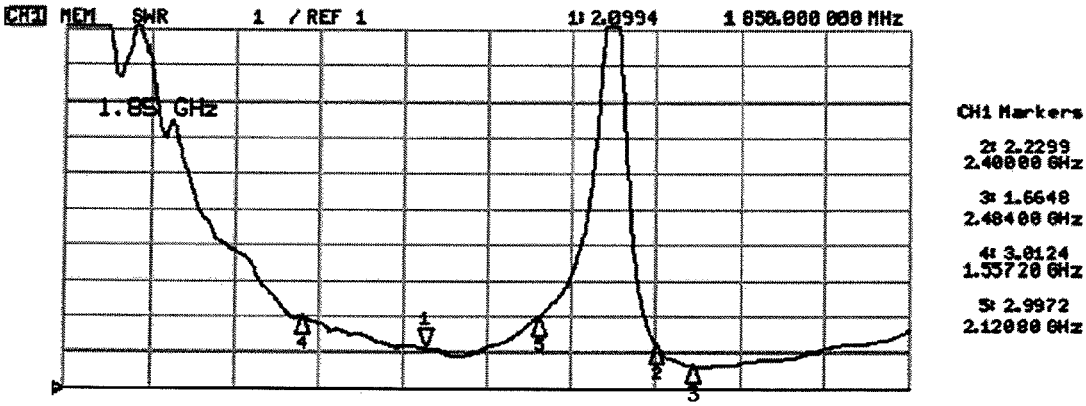

FIG. 6 is a graph illustrating results of frequency tuning via an internal antenna having a perpendicular arrangement according to an embodiment of the invention.

In the graph of FIGS. 6(*a*) to 6(*c*), a longitudinal axis indicates a VSWR which is 1 at the lowest point and increased by 1 per scale in an upward direction. A lateral axis indicates a frequency. Frequencies and VSWR measured at a point marked with "Δ" are exhibited on the right side and upper part. FIGS. 6(*a*) to 6(*c*) illustrate dual resonance implemented by adjusting a tuning point of the internal antenna 30 having the perpendicular arrangement of the invention. According to the invention, the internal antenna 30 having the perpendicular arrangement can process a dual-band and even a multi-band by adjusting a distance between the first antenna part 31 and second antenna part 32 of the internal antenna 30 having the perpendicular arrangement or an electrical length of a radiator installed inside the first and second antenna parts 31 and 32.

Figure 7:
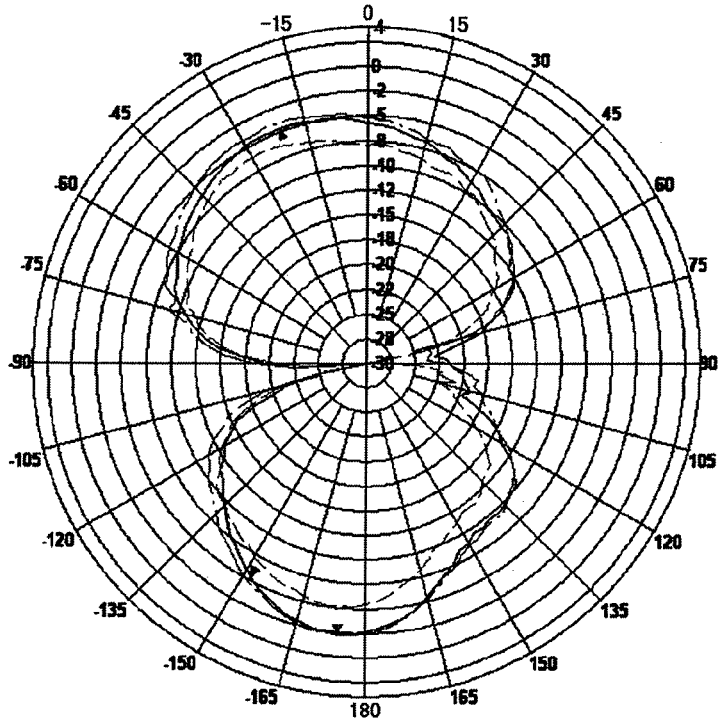
FIG. 7 is a graph illustrating an E-plane radiation pattern of an antenna having a perpendicular arrangement according to an embodiment of the invention.
Figure 7:
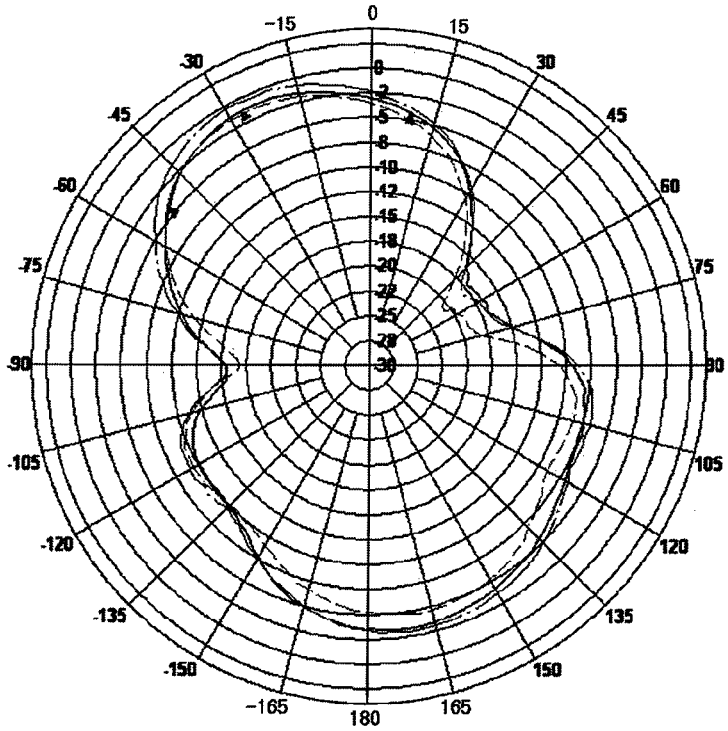

FIG. 7(*a*) is a graph illustrating an E-plane radiation pattern of an internal antenna having a perpendicular arrangement according to an embodiment of the invention.

FIG. 7*a* illustrates an E-plane radiation pattern of a chip antenna having a bandwidth BW of 125 MHz at a center frequency of 2.5 GHz, the same as used in FIG. 5(*a*), when employed in a mobile telecommunication terminal. Referring to FIG. 5(*a*), in case where a chip antenna is used in the mobile telecommunication terminal, a null point is formed at 85 and −95 degrees.

FIG. 7(*b*) illustrates an E-plane radiation pattern of a chip antenna having properties of FIG. 5(*a*), when employed in the first and second antenna parts 31 and 32 of the internal antenna 30 having the perpendicular arrangement. As shown in FIG. 7(*b*), the internal antenna having the perpendicular arrangement of the invention ensures an increase in gain over a null point and an overall increase in average gain.

Figure 8:
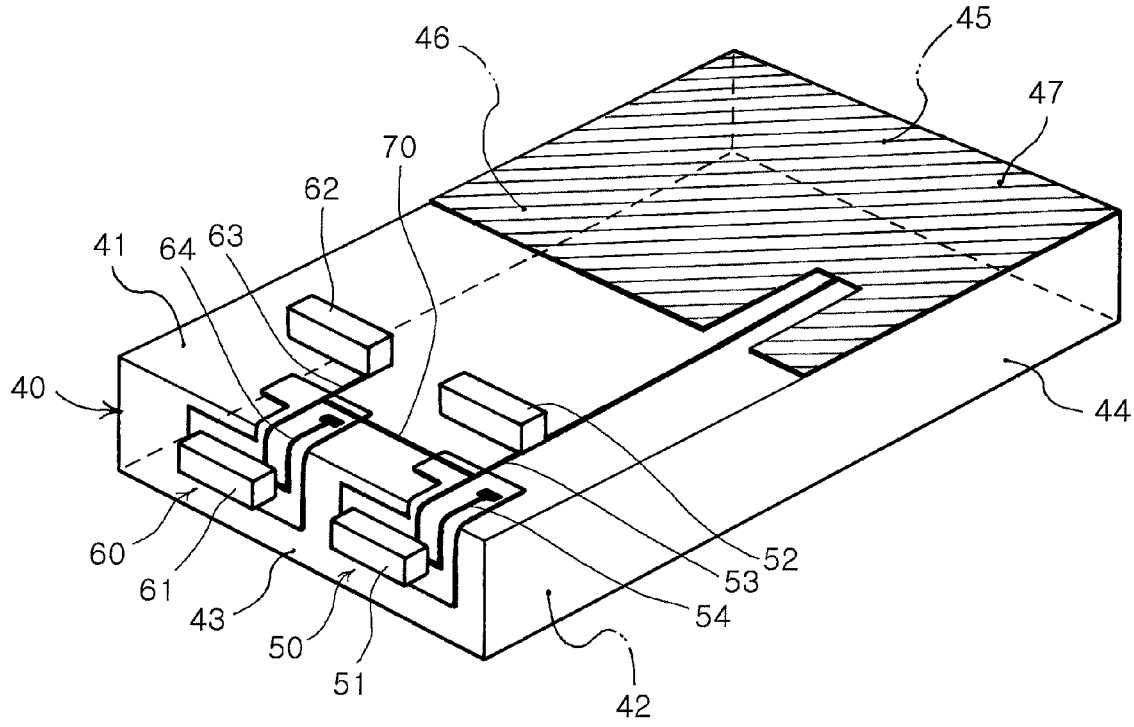
FIG. 8 is a configuration view illustrating a serial antenna having a perpendicular arrangement according to another embodiment of the invention.

FIG. 8 is a configuration view illustrating a serial internal antenna having a perpendicular arrangement according to another embodiment of the invention.

Referring to FIG. 8, in the serial internal antenna having the perpendicular arrangement of the invention, a feeding structure of a first antenna part 50 having a perpendicular arrangement is serially connected to that of a second antenna 60 having a perpendicular arrangement. The first and second antennas 50 and 60 having the perpendicular arrangement feature a structure equal to that of the internal antenna 30 having the perpendicular arrangement explained in FIGS. 3 and 4.

That is, the first antenna 50 having the perpendicular arrangement includes a first antenna part 51, a second antenna part 52, a first feeding part 53 and a ground part 54. The first antenna part 51 is disposed on a side 43 of a mobile telecommunication terminal body 40 and processes a signal of a first band. The second antenna part 52 is disposed on a peripheral surface 41 of the terminal body 40 and processes a signal of a second band higher than the first band. Also, the second antenna 60 having the perpendicular arrangement includes a third antenna 61, a fourth antenna 62, a second feeding part 63 and a ground part 64. The third antenna 61 is disposed on the side 43 of the mobile telecommunication terminal body and processes a signal of a third band. The fourth antenna 62 is disposed on the peripheral surface 41 of the terminal body 40 and processes a signal of a fourth band higher than the third band. Here, the first band and the third band may be equally structured and so may the second band and the fourth band. But they may be differently configured according to a desired bandwidth and multi-band properties Further, the first feeding part 53 of the first antenna 50 having the perpendicular arrangement is electrically connected to the second feeding part 63 of the second antenna 60 having the perpendicular arrangement, thereby forming a serial antenna having a 2×2 perpendicular arrangement. The conductive line 70 is structured to connect a point between the first and second antenna parts 51 and 52 in the first feeding part 53 of the first antenna 50 to a point between the third and fourth antennas 61 and 62 in the second feeding part 63 of the second antenna 60. Therefore, current flowing to an end of the first feeding part 53 of the first antenna 50 having the perpendicular arrangement can be supplied to the first to fourth antennas 51, 52, 61 and 62.

Figure 9:
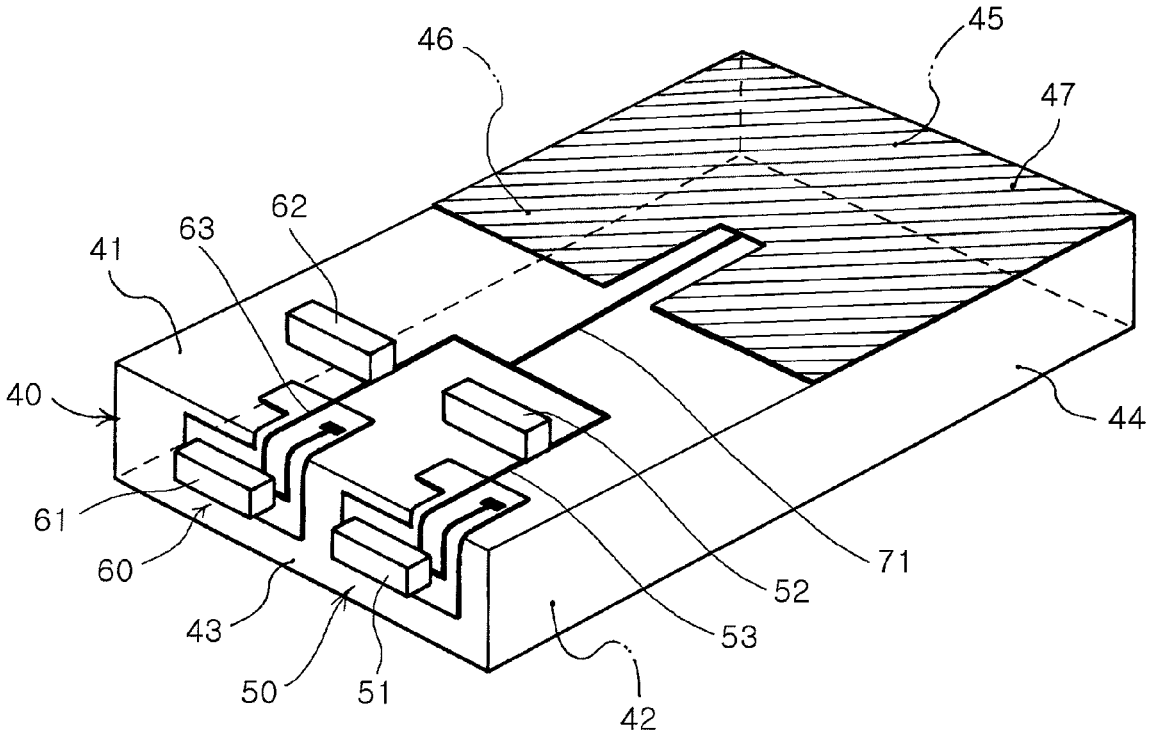
FIG. 9 is a configuration view illustrating a parallel antenna having a perpendicular arrangement according to further another embodiment of the invention.

FIG. 9 is a configuration view illustrating a parallel internal antenna having a perpendicular arrangement according to further another embodiment of the invention.

Referring to FIG. 9, in the parallel internal antenna having the perpendicular arrangement of the invention, a feeding structure of the first antenna 50 having the perpendicular arrangement is connected in parallel to that of the second antenna 60 having the perpendicular arrangement. The parallel internal antenna having the perpendicular arrangement has a common feeding part 71 formed therein. The common feeding part 71 is connected to an end of the second feeding part 53 of the first antenna 50 and to an end of the second feeding part 63 of the second antenna 60. This allows the parallel internal antenna having a 2×2 perpendicular arrangement according to this embodiment of the invention. As a result, current flowing through the common feeding part 71 may be supplied to the first to fourth antennas 51, 52, 61 and In this fashion, according to this embodiment of the invention, an antenna having a 1×2 or 2×2 perpendicular arrangement can be installed inside a small-sized mobile telecommunication terminal, thereby providing wide-band or multi-band properties.

As set forth above, according to preferred embodiments of the invention, a first antenna part is disposed on a side of a mobile telecommunication terminal body and a second antenna part is disposed on a peripheral surface of the terminal body. This leads to a smaller space for the antenna installed inside the mobile telecommunication terminal. In addition, advantageously the mobile telecommunication terminal of certain embodiments of the invention can easily process wide-band or multi-band signals by adjusting a distance between the first and second antenna parts or a length of an internal radiator.

While the present invention has been shown and described in connection with the preferred embodiments, it will be apparent to those skilled in the art that modifications and variations can be made without departing from the spirit and scope of the invention as defined by the appended claims.

What is claimed is:

1. An internal antenna having a perpendicular arrangement, said antenna comprising:

a first chip antenna part for processing a signal of a first band, the first chip antenna part being disposed on a side surface of a mobile telecommunication terminal body which also has opposite first and second main surfaces, the side surface connecting said main surfaces and being perpendicular to at least said first main surface;

a second chip antenna part for processing a signal of a second band different from the first band, the second chip antenna part being disposed on the first main surface of the mobile telecommunication terminal body, wherein the first and second chip antenna parts have an identical lengthwise direction;

a first feeding part for feeding current to the first and second chip antenna parts through an equal feeding line;

a third chip antenna part for processing a signal of a third band, the third chip antenna part being disposed on the side surface of the mobile telecommunication terminal body on which the first chip antenna part is disposed;

a fourth chip antenna part for processing a signal of a fourth band different from the third band, the fourth chip antenna part being disposed on the first main surface of the mobile telecommunication terminal body on which the second chip antenna part is disposed; and a second feeding part for feeding current to the third and fourth chip antenna parts through an equal feeding line, wherein the second feeding part is electrically connected to the first feeding part.

2. The internal antenna according to claim 1, wherein the first and second chip antenna parts define a first antenna structure;

the third and fourth chip antenna parts define a second antenna structure;

the first and second antenna structures are serially connected by a conductive line which connects a first middle point of the first feeding part between the first and second chip antenna parts with a second middle point of the second feeding part between the third and fourth chip antenna parts.

3. The internal antenna according to claim 2, wherein second band is higher than the first band, and the fourth band is higher than the third band.

4. The internal antenna according to claim 1, wherein the first and second chip antenna parts define a first antenna structure;

the third and fourth chip antenna parts define a second antenna structure;

the first and second antenna structures are connected in parallel with ends of the first and second feeding parts being commonly connected to a common feeding part.

5. The internal antenna according to claim 4, wherein second band is higher than the first band, and the fourth band is higher than the third band.

* * * * *